United States Patent [19]

Hackney

[11] Patent Number: 4,557,212

[45] Date of Patent: Dec. 10, 1985

[54] BEARING SYSTEMS FOR SAILCRAFT GOOSENECK UNITS

[76] Inventor: John Hackney, 1026 NW. 16th St., Stuart, Fla. 33494

[21] Appl. No.: 607,566

[22] Filed: May 7, 1984

[51] Int. Cl.[4] ..... B63B 15/00

[52] U.S. Cl. ..... 114/98

[58] Field of Search ..... 114/39, 90, 97, 98, 114/99, 102, 104, 108, 112; 16/223, 243, 248, 273, 328

[56] References Cited

U.S. PATENT DOCUMENTS 259,209 6/1882 Rand ..... 114/112

2,488,918 11/1949 Manchester ..... 114/115

*Primary Examiner*—Trygve M. Blix

*Assistant Examiner*—Jesûs D. Sotelo

*Attorney, Agent, or Firm*—Carroll F. Palmer

[57] ABSTRACT

Bearing systems for gooseneck units used to hold booms onto the masts of sailcraft comprise a pair of substantially identical bearing members, except that the central longitudinal bore of one member is smaller than such bore of the other member. Each of the members comprise a small portion that can fit into the longitudinal channel of the slide member of the gooseneck unit and a large, integral portion that will not fit into the channel, but is contoured to slide within a vertical track in the aft side of the mast of the sailcraft. The pair of bearing members is fastened into the channel of the slide member by a screw long enough to span the channel, which screw has a diameter smaller than the larger bore of the bearing members, but larger than the smaller bore of the bearing members permitting the screw to be threaded into the smaller bore. Preferably, the bearing members are made of low friction, plastic material so the large portions of such members will slide easily, vertically in the mast vertical track enabling the boom to be readily raised or lower along the mast.

2 Claims, 7 Drawing Figures

FIG. 1
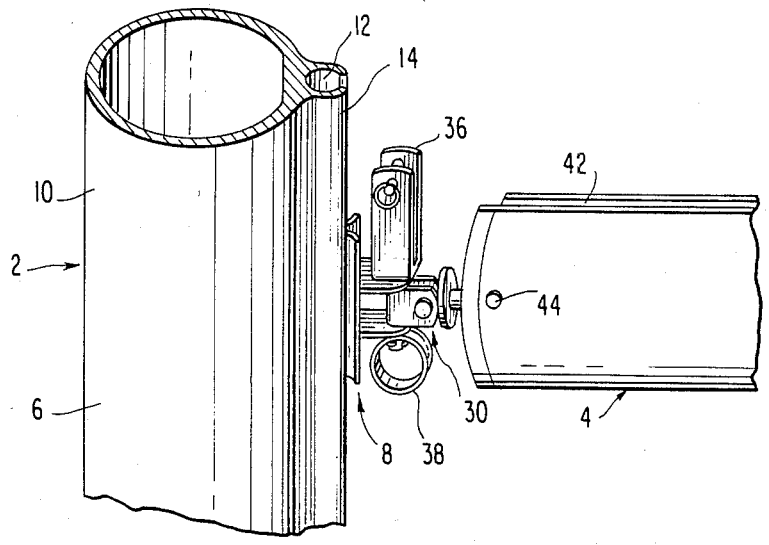
FIG. 2
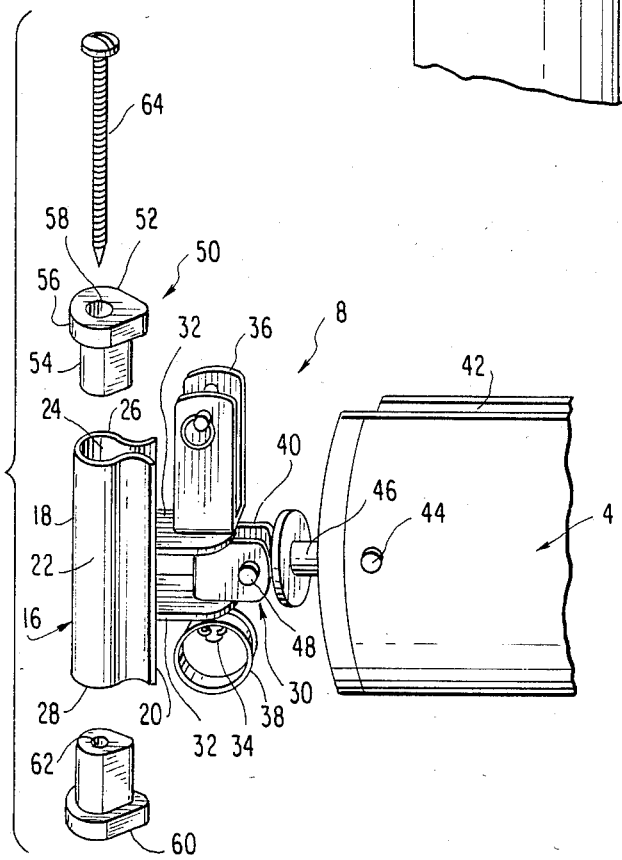
FIG. 3
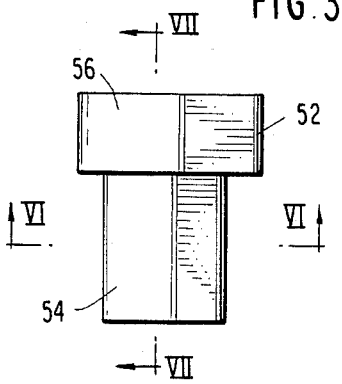
FIG. 4
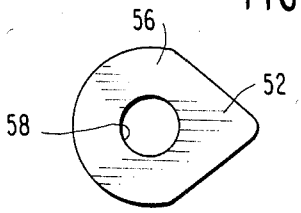
FIG. 5
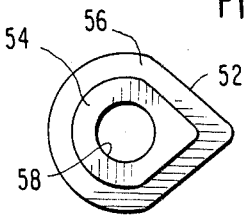
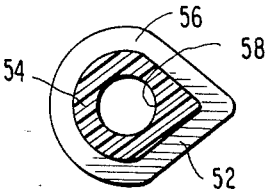
FIG. 6
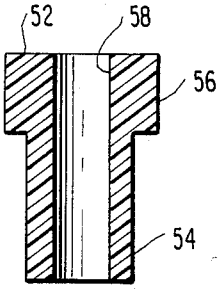
FIG. 7

BEARING SYSTEMS FOR SAILCRAFT GOOSENECK UNITS

BACKGROUND OF THE INVENTION

1. Field of the Invention

This invention relates broadly to bearing systems for use in combination with sailcraft gooseneck units. More particularly, it concerns such bearing systems to be employed with gooseneck units that are moveable along sailcraft masts in aft vertical tracks in the masts, in contrast to gooseneck units that are immoveably fixed to the mast.

2. Description of the Prior Art

Gooseneck units are hardware items used on sailcraft, e.g., sailboats, iceboats, etc., to hold the boom of a sail rig onto the mast while permitting the boom to move horizontally aft of the mast as required to bring the sailcraft over from one tack to the other. Such units are of two general types, i.e., those that are moveable vertically along the mast to adjust the height of the foot of the sail relative to the waterline and those that are immoveably fixed so the foot of the sail remains at a fixed height above the waterline. The present invention relates to the former type of gooseneck unit.

The vertically moveable type of gooseneck is frequently employed on high-performance sailcraft, i.e., racing boats, because this provides an additional means for sail control. Thus, a down-haul can be used with the moveable gooseneck unit to stretch the luff of the sail, which, in turn, controls the sail shape to obtain maximum efficiency out of the sail for varying wind conditions.

Several schemes have been developed to permit the gooseneck to move up and down on the supporting mast. One method widely used, particularly on the smaller sailcraft such as racing catamarans, iceboats, racing dinghys, etc. is to employ an mast that has a longitudinal track built into the aft side of the mast in which a slide member of the gooseneck unit is slideably held for up and down movement. Masts of this type are typically made of sections of extruded aluminum or other metal. The present invention is directed to improvements in this type of sail rig.

Typically in the gooseneck units designed with slide members to move in an aft track in the mast as just mentioned, the mast is metal and the slide member is also metal, e.g., a short section of extruded metal channel. The slide member functions as a bearing for the gooseneck unit upon the mast with the result that large lateral forces are exerted between the outer surface of the slide member and the inner surface of the mast track during operation of the sail rig. Hence, there a tendency for the slide member to bind in the mast track to impede the adjustment of the slide member with change in sailing conditions, e.g., angle of sail, wind direction, etc. This is a particular problem for high-performance sailcraft were prompt adjustment of the gooseneck position without binding problems is essential to efficient operation of the sailcraft. The present invention concerns improvements in sailcraft gooseneck units that mitigates this existing problem of the prior known units.

OBJECTS

A principal object of this invention is the provision of new improvements in gooseneck units for sailcraft. Further objects include the provision of:

1. New bearing systems for the gooseneck units of sailcraft booms.

2. Such bearing systems designed for use with gooseneck units that slide vertically in a track in the aft end of the mast in a sail rig.

3. Such bearing systems that provide the required strength for support of a boom on a mast in a sail rig while mitigating against hang up of the gooseneck unit on the mast due to binding lateral forces.

4. New combinations of gooseneck units and bearing systems for their slide members that are particularly useful in the rigging and handling of high-performance sailcraft.

5. New bearing systems for sailcraft boom gooseneck units that will make downhaul adjustment smooth and easy, assist the gooseneck slide member not to get hung up in the mast track and mitigate damage to the mast track.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of unique bearing systems for the gooseneck units of sailcraft booms.

The gooseneck units with which the new bearing systems are used include an elongated slide member having a fore side, an aft side, an external surface contoured to slide vertically in a longitudinal track that extends vertically on the aft side of the mast of the sailcraft carrying the boom and an internal longitudinal channel that extends from end to end of the slide member. Such unit also has pivot means extending from the aft side of the slide member by which the sailcraft boom is supported by the slide member to swing horizontally aft of the sailcraft mast.

The new bearing systems comprise a first bearing member having a first portion contoured to telescope into the channel of the slide member of the gooseneck unit, a second portion integral with the first portion contoured to slide vertically along the track on the aft side of the mast, and a bore extending longitudinally and approximately centrally through the first and second portions. The cross-section of the second portion is larger than the first portion so the first portion can enter the channel of the gooseneck unit slide member while the second portion can not.

The bearing systems also include a second bearing member that is substantially identical to the first bearing member except that the bore of the second bearing member is smaller in cross-section than the bore of the first bearing member.

A further element of the bearing systems is a screw with a diameter that permits it to slide through the bore of the first bearing member and to thread into the bore of the second bearing member. The screw is long enough that it can span the channel of the slide member to hold the first and second members of the bearing systems in the ends of the channel of the gooseneck unit.

BRIEF DESCRIPTION OF THE DRAWINGS

A more complete understanding of the invention may be had by reference to the accompanying drawings in which:

FIG. 1 is a fragmentary, isometric view of a portion of the sail rig of a sail craft having a boom supported on a mast by a gooseneck unit equipped with a bearing system of the invention.

FIG. 2 is an fragmentary, isometric, exploded view of the boom and gooseneck portion of the sail rig shown in FIG. 1

FIG. 3 is a lateral view of a bearing member of a bearing system of the invention.

FIG. 4 is a top plan view of the bearing member of FIG. 3.

FIG. 5 is a bottom plan view of the bearing member of FIG. 3.

FIG. 6 is a sectional view taken on the line VI—VI of FIG. 3.

FIG. 7 is a sectional view taken on the line VII—VII of FIG. 3.

DESCRIPTION OF PREFERRED EMBODIMENTS

Referring in detail to the drawings, the sailcraft sail rig 2 comprises a boom 4, mast 6 and gooseneck unit 8.

In the embodiment of the FIG. 1, the mast 6 comprises an elongated tubular section 10 of extruded metal having an integral longitudinal track 12 formed in the aft end 14. However, other forms (not shown) of sail rigs may be used with the new gooseneck combinations of the invention. For example, the mast 6 may be formed separately from the longitudinal track 12 such as by having the track 12 in the form of a metal or plastic channel held by fasteners to the aft end of a metal or wooden mast.

The gooseneck unit 8 includes an elongated slide member 16 having a fore side 18, an aft side 20, an external surface 22 contoured to slide vertically in the mast track 12 and an internal longitudinal channel 24 that extends from one end 26 to the other end 28 of the slide member 16.

The gooseneck unit 8 also has pivot means 30 extending from the aft side 20 of the slide member 16 by which the boom 4 is supported by the slide member 16 to swing horizontally aft of the mast 6.

The pivot means 30 of the illustrated embodiment comprises a pair of lugs 32 that extend aft laterally from the aft side 20 of the slide member 16. These lugs each have a hole (not shown) in their aft end through which a clevis pin 34 extends to fasten the sail shackle 36, downhaul ring 38 and boom shackle 40 to the lugs 32 to form a part of the pivot means 30 of the gooseneck unit 8.

The boom 4 includes a longitudinal, upper track 42 into which the foot rope of the sail (not shown) carried by the boom 4 and mast 6 can be reeved. Also, there is fixed to the boom 4 by the cross rivet 44 a forward extending pin 46 that has a forward hole (not shown) through which the clevis 48 extends to fasten the boom 4 to the pivot means 30.

The new bearing system 50 for the gooseneck unit 8 comprises a first bearing member 52 having a first portion 54 contoured to telescope into the channel 24 of the slide member 16 and a second portion 56 integral with the first portion 54 contoured to slide smoothly vertically along the track 12 on the aft side 14 of the mast 6. Member 52 also has a bore 58 extending longitudinally and approximately centrally through the first and second portions 54 & 56. The cross-section of the second portion is larger than the first portion (see FIG. 6) so the first portion 54 can enter the channel 24 while the second portion 56 can not.

The bearing systems also include a second bearing member 60 that is substantially identical to the first bearing member 52 except that the bore 62 of the second bearing member 60 is smaller in cross-section than the bore 58 of the first bearing member 52.

Both bearing members 52 and 60 are advantageously molded of plastic material exhibiting low surface friction characteristics so such members can slide easily in the mast track 12.

A further element of the bearing system 50 is a screw 64 with a diameter that permits it to slide through the bore 58 of the first bearing member 52 and to thread into the bore 62 of the second bearing member 60. The screw is long enough that it can span the channel 24 and hold the first and second members 52 & 60 in the ends 26 & 28 of the channel 24.

Installation of the new bearing systems of the invention into a gooseneck unit is easily accomplished. The gooseneck unit not equipped with a new bearing system is removed from the mast 6 by feeding the slide member 16 out of the mast track 12. Then the first bearing member 52 is inserted snugly in either end 26 or 28 of the channel 24, applying light tapping with a mallet if necessary. The second bearing member 60 is then inserted in the remaining end 26 or 28. Next, the screw 64 is inserted through bore 58 of member 52 and threaded into the bore 62 of member 60. The screw is then tightened with a screw driver to firmly fix the bearing system into the gooseneck unit 8. When tight, the tip of screw 64 should not protrude from bearing member 60. If it does, the excess may be removed by filing. Finally, the gooseneck unit 8 is remounted on the mast 6 by feeding the bearing members 52 and 60 into the mast track 12.

The embodiment of the invention in which an exclusive property or privilege is claimed are defined as follows:

1. A bearing system for the gooseneck unit of a sailcraft boom wherein said gooseneck unit includes:
   - an elongated slide member having
     - a fore side,
     - an aft side,
     - an external surface contoured to slide vertically in a longitudinal track that extends vertically on the aft side of the mast of said sailcraft and
     - an internal longitudinal channel that extends from end to end of said slide member, and
   - pivot means extending from said aft side of said slide member by which said sailcraft boom is supported by said slide member to swing horizontally aft of said mast, said beariing system comprising:
   - a first bearing member having
     - a first portion contoured to telescope into said channel of said slide member and
     - a second portion integral with said first portion and contoured to slide vertically along said track on the aft side of said mast, and
     - a bore extending longitudinally and approximately centrally through said first and second portions,
     - the cross-section of said second portion being larger than the cross-section of said first portion whereby said first portion can enter said channel while said second portion can not, a second bearing member that is substantially identical to said first bearing member except that the bore of said second bearing member is smaller in cross-section than the bore of said first bearing member, and a screw with a diameter and length that permits it to slide through said bore of said first bearing member and to thread into said bore of said second bearing member when said bearing members are fitted into opposite ends of said channel of said slide member.

2. The bearing system of claim 1 wherein said first and second bearing members are molded of rigid plastic material that exhibits low surface friction.

* * * * *